US010630005B1

(12) United States Patent
Ridley

(10) Patent No.: US 10,630,005 B1
(45) Date of Patent: Apr. 21, 2020

(54) METHOD FOR COUPLING AN ELECTRICAL CONDUCTOR TO AN ELECTRICAL CONNECTOR UTILIZING GENERIC FERRULE

(71) Applicant: International Hydraulics Inc., Mentor, OH (US)

(72) Inventor: Charles D. M. Ridley, Aurora, OH (US)

(73) Assignee: INTERNATIONAL HYDRAULICS INC., Mentor, OH (US)

( * ) Notice: Subject to any disclaimer, the term of this patent is extended or adjusted under 35 U.S.C. 154(b) by 0 days.

(21) Appl. No.: 16/357,923

(22) Filed: Mar. 19, 2019

(51) Int. Cl.
*H01R 4/30* (2006.01)
*H01R 4/18* (2006.01)

(52) U.S. Cl.
CPC ..... *H01R 4/30* (2013.01); *H01R 4/183* (2013.01)

(58) Field of Classification Search
CPC ..... H01R 4/30; H01R 4/183; H01R 4/188; H01R 4/185; H01R 43/048
USPC ..... 439/877
See application file for complete search history.

(56) References Cited

U.S. PATENT DOCUMENTS 3,125,397 A * 3/1964 McGrath ..... H01R 4/363 439/811
4,213,669 A * 7/1980 Wittes ..... H01R 4/36 439/811
5,201,914 A * 4/1993 Hollick ..... H01R 4/36 439/801
5,445,544 A * 8/1995 Weiland ..... H01R 4/20 439/879
5,533,913 A * 7/1996 Boehm ..... H01R 4/36 439/810
6,764,354 B2 * 7/2004 Kaine ..... H01R 4/363 439/606
7,624,908 B2 12/2009 Enyedy et al.
7,976,352 B2 * 7/2011 Nishimura ..... H01R 4/36 439/814
8,348,706 B2 * 1/2013 Yu ..... H01R 4/36 439/737

(Continued)

OTHER PUBLICATIONS

NPL_CITE_1—Polaris Grey Connectors PDF available at least as early as Mar. 20, 2019 at: https://polarisconnectors.com/pdfs/NSi/Grey_series.pdf.

*Primary Examiner* — Peter G Leigh
(74) *Attorney, Agent, or Firm* — Patentfile, LLC; Bradley C. Fach; Steven R. Kick

(57) ABSTRACT

An electrical coupling method for coupling an electrical conductor to a connector may provide for the elimination of pre-crimping, crimp tooling and pre-crimp UL testing certifications that go with it, and by testing standard generic ferrules in the said Dual Rated connectors, and by use of a UL approved instruction sheet, for the user to utilize generic ferrules. The may include the steps of: inserting one or more electrical conductors and an uncrimped ferrule into a connector aperture of an electrical connector, the one or more electrical conductors and uncrimped ferrule being uncoupled to each other prior to insertion into the connector aperture; and screwing a clamping screw so that preferably the clamping screw simultaneously (i) crimps the uncrimped ferrule to the first electrical conductor and (ii) secures the ferrule and first electrical conductor to the electrical connector within the connector aperture.

13 Claims, 7 Drawing Sheets

(56) References Cited

U.S. PATENT DOCUMENTS

| | | | | |
|---|---|---|---|---|
| 8,987,595 | B2 * | 3/2015 | Bumgarner | H01R 4/363<br>174/84 R |
| 9,553,374 | B1 * | 1/2017 | Murugiah | H01R 4/5091 |
| 9,929,477 | B2 * | 3/2018 | Beiler | H01R 4/366 |
| 10,122,096 | B2 * | 11/2018 | Ruland | H01R 4/302 |
| 2004/0077224 | A1 * | 4/2004 | Marchese | H01R 4/30<br>439/696 |
| 2005/0202732 | A1 * | 9/2005 | Rizzo | H01R 4/36<br>439/810 |
| 2008/0268721 | A1 * | 10/2008 | Waltz | H01R 4/36<br>439/793 |

* cited by examiner

METHOD FOR COUPLING AN ELECTRICAL CONDUCTOR TO AN ELECTRICAL CONNECTOR UTILIZING GENERIC FERRULE

FIELD OF THE INVENTION

This patent specification relates to the field of electrical coupling systems and methods. More specifically, this patent specification relates to systems and methods for electrically coupling an electrical conductor to an electrical connector.

BACKGROUND

As a practical matter, in the USA and Canada the majority of residential, commercial, and industrial electrical wire connections need to be made using connectors certified to the Underwriters Laboratories UL 486A-486B wire connector standard of testing (in Canada the same harmonized standard is named C22.2 No. 65), in order to comply with the NEC (National Electrical Code) and other NFPA (National Fire Protection Association) and other applicable safety codes. An electrical current carrying wire (or "conductor") terminal connector that is not already appropriately tested and certified by the appropriate NRTL (National Recognized Testing Laboratory) for connecting a particular wire type is of little commercial value, is potentially unsafe, and commonly voids fire insurance policies due to risk.

When connecting certain stranded or flexible copper stranded wire in mechanical screw compression wire connectors, users are frequently required by electrical and fire safety codes and/or customer specification or preferences, to use a copper ferrules (a thin wall tubular copper sleeve with a flared mouth for ease of wire insertion) to protect the fragile wire strands from damage by the wire compression screw. Also, the ferrule is useful as an orderly means of controlling the fine strands of stranded or flexible wire during insertion into a connector. These standard marketplace ferrules, by convention, and past practice, are crimped onto the wire first, using specified crimping tools and dies, before being finally and additionally clamped inside the wire connector itself. That wire and ferrule crimping procedure is also subject to certification under UL486A-B/C22.2 No. 65 or UL486F for the joint to have broad commercial use in Listed wire connectors. In spite of this additional ferrule-to-wire-crimp testing work, the certified wire and crimped ferrule combination is still not generally permitted to be used in a standard wire connector until the ferrule and wire combination has been tested a second time as a crimped ferrule wire assembly.

Standard "generic" DIN46228 part 1 and part 4 ferrules that have been further tested using UL486F or UL486A/C22.2 No. 65 for crimping using special crimping tools the many different wire sizes and stranding types, typically have a premium cost, and less commonplace than generic standard DIN 46228 ferrules. Mass produced generic ferrules are not burdened with the testing cost and therefore are relatively more economic. The standard generic ferrules are made to the same construction requirements originally defined in DIN standard 46228 parts 1 and 4.

The difference is mainly that of pre-testing, packing and labeling with the rated wire and ferrule combinations.

The purchase of specially assigned ferrule crimping tools and dies for UL certified ferrules increases the user cost further and can be very inconvenient since they must be acquired before the wire connection can be made.

Prior devices show a long standing use of built-in component ferrule, OEM custom design (custom non-standard ferrules and which cannot be used without the ferrule), having a single sized ferrule for all wires in the entire connector range, which does serve to eliminate the pre-crimping of the wire and therefore also eliminates certified crimping tools from the user requirements. However, the connector has to be covered in insulation in order to have a means to retain the custom ferrule component, making it expensive. Additionally, and crucially, the Dual Rated certification is lost, since the integrated, and always required and supplied copper ferrule does not support UL486B/C22.2 No. 65 aluminum wire ratings. The single maximally sized, specially dimensioned OEM ferrule, integrated into previous connectors, does not solve the need for a single connector that can utilize ferrules on copper wire, only when needed, still without special crimping tools, and at the same time, be certified to connect all forms of common NEC code wire including aluminum wire, retaining the connector's Dual Rated certification for both copper and aluminum conductors.

The mainstream approach which maintains the Dual Ratings for aluminum and copper wire requires that ferrules be previously pre-crimp certified for use with the stranded copper wire being used and additionally, certified again in the wire connector as a pre-crimped ferruled wire, further clamped by the connector clamping screw. This is a duplication of testing and, in every single use of the ferrule, a duplication of the crimping method labor costs.

Therefore, a need exists for novel electrical coupling methods for forming electrical connections. A further need exists for novel electrical coupling methods which form electrical connections that are certified to connect all forms of common NEC code wire including aluminum wire, retaining the connector's Dual Rated certification for both copper and aluminum conductors. There is also a need for novel electrical coupling methods which form electrical connections without the need for special crimping tools and their associated tooling, labor, and time costs.

BRIEF SUMMARY OF THE INVENTION

An electrical coupling method for coupling an electrical conductor to a connector is provided. The electrical coupling method eliminates all of the fore-mentioned impediments, delivering one or more solutions which may include A Listed, Dual Rated, UL486A-486B/C22.2 No. 65 electric coupling methods which meets UL486A (copper wire) on bare wire, and, when used with mass produced, generic, low cost ferrules on stranded copper wire, by not requiring use of special pre-crimping tooling and dies, eliminates the labor of pre-crimping of the ferrule to the wire with the said tooling and dies, and also maintains the connector's UL rating for aluminum wire to UL486B standard, when used conventionally without ferrules on the wire.

The electrical coupling method preferably may provide for the elimination of pre-crimping, crimp tooling and pre-crimp UL testing certifications that go with it, and by testing standard generic ferrules in the said Dual Rated connectors, and by use of a UL approved instruction sheet, for the user to utilize generic ferrules, matching up a tabulated list of the generic sizes of the ferrule and the chosen wire gauge being used in the given enhanced universal rated connector.

A generic ferrule itself needs no previous testing certifications on the numerous wire sizes and stranding classes, since the UL testing is already carried out. Additionally, the electrical coupling method allows ferrules that do have existing certifications to be used as equals to the generic ferrules, since the construction of the ferrules is the same by common convention regardless of additional testing certifications.

The end result gives the ability of a user to utilize the electrical coupling method in the form of a previously or newly UL Listed Dual Rated (aluminum or copper wire) screw type wire connector, already able to connect a variety of solid, stranded and fine stranded copper wires but which is additionally certified by UL/CSA which crimps the ferrule and the wire at a predetermined torque which satisfies electrical and mechanical performance requirements for certification to UL486A/Canada C22.2 no. 65 (copper wire) and maintaining UL486B/C22.2 No. 65 (aluminum wire) ratings when using standard coarsely stranded aluminum wires with no ferrule. This simultaneously certifies the generic ferrule stranded wire and connector.

The electrical coupling method may provide a new "all-in-one" "no special tools required", enhanced universal certification connector, which allows users to buy ferrules in a wider marketplace, to keep on hand, low cost, mass produced, generic ferrules to be used when connecting wires without prior crimping. No OEM special ferrules need be purchased from the maker of the enhanced universal connector, nor need they be part of a special connector that utilizes a custom OEM ferrule, built into the connector. Nor do the ferrules themselves need to be pre-certified by the generic ferrule maker for any particular wire stranding class, but may be acquired by the end user at any time and utilized at will, on the enhanced universal pre-certified connectors.

In some embodiments, an electrical coupling method for coupling an electrical conductor to a connector may include the steps of: inserting one or more electrical conductors and an uncrimped ferrule into a connector aperture of an electrical connector, the one or more electrical conductors and uncrimped ferrule being uncoupled to each other prior to insertion into the connector aperture; and screwing a clamping screw so that the clamping screw simultaneously (i) crimps the uncrimped ferrule to the first electrical conductor and (ii) secures the ferrule and first electrical conductor to the electrical connector within the connector aperture.

In further embodiments, an electrical coupling method for coupling an electrical conductor to a connector may include the steps of: inserting a terminus of one or more electrical conductors into a ferrule aperture of an uncrimped ferrule having a symmetrical shape at its cylindrical portion and inserting a portion of the uncrimped ferrule into a connector aperture of an electrical connector, the one or more electrical conductors and uncrimped ferrule being in an uncoupled state upon insertion of the ferrule into the connector aperture; and engaging a clamping screw of the electrical connector so that the clamping screw simultaneously (i) deforms the symmetrical shape of the ferrule to frictionally couple the first electrical conductor to the ferrule and (ii) frictionally couples the ferrule to the electrical connector within the connector aperture.

In still further embodiments, an electrical coupling method for coupling an electrical conductor to a connector may include the steps of: inserting a terminus of one or more electrical conductors into a connector aperture of an electrical connector, the one or more electrical conductors optionally being in an uncoupled state upon insertion into the connector aperture; and engaging a clamping screw of the electrical connector so that the clamping screw frictionally couples the electrical connectors within the connector aperture.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
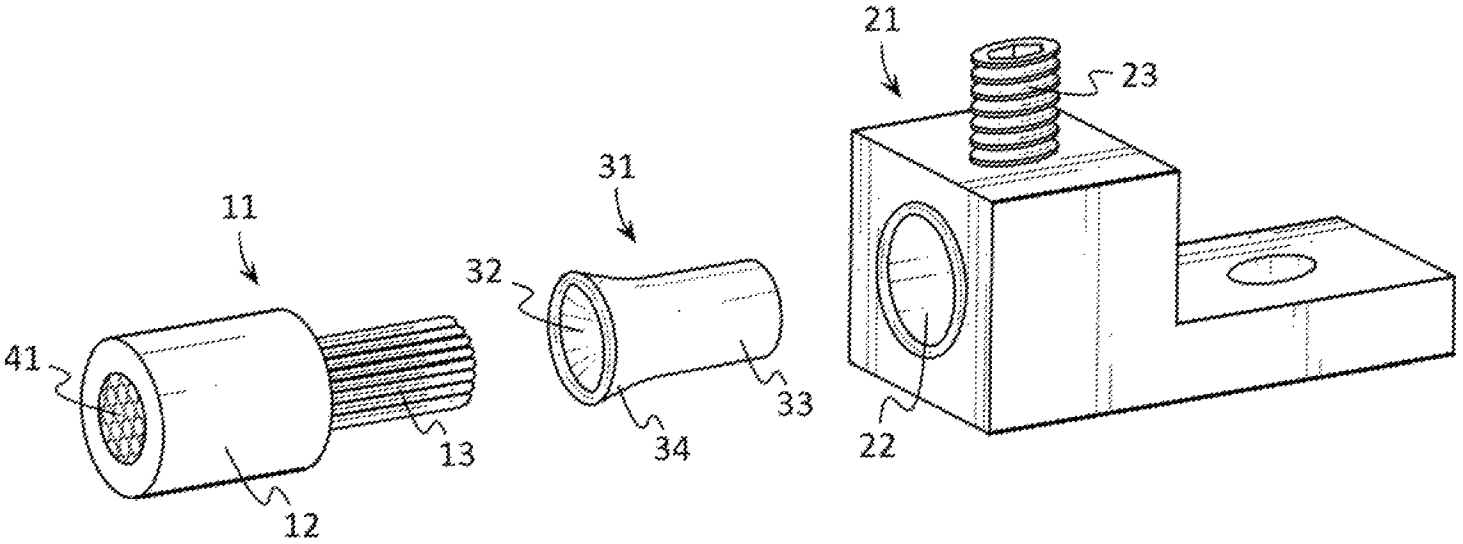
FIG. 1 depicts a perspective view of an example of an electrical conductor, a ferrule, and an electrical connector prior to the start of an electrical coupling method according to various embodiments described herein.
Figure 2:
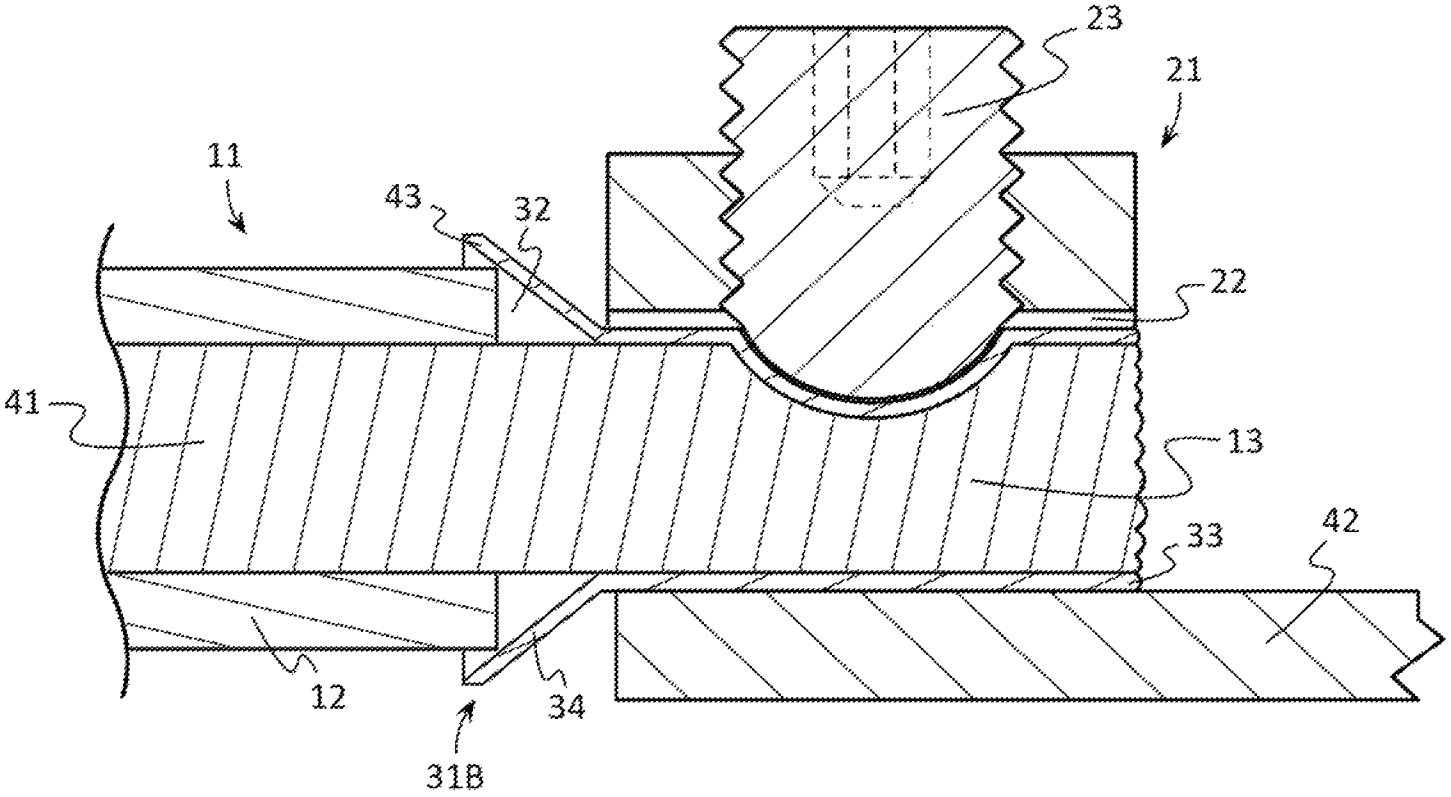
FIG. 2 illustrates a partial perspective sectional view of an example of an electrical conductor, a ferrule, and an electrical connector after the performance of steps of an electrical coupling method according to various embodiments described herein.
Figure 3:
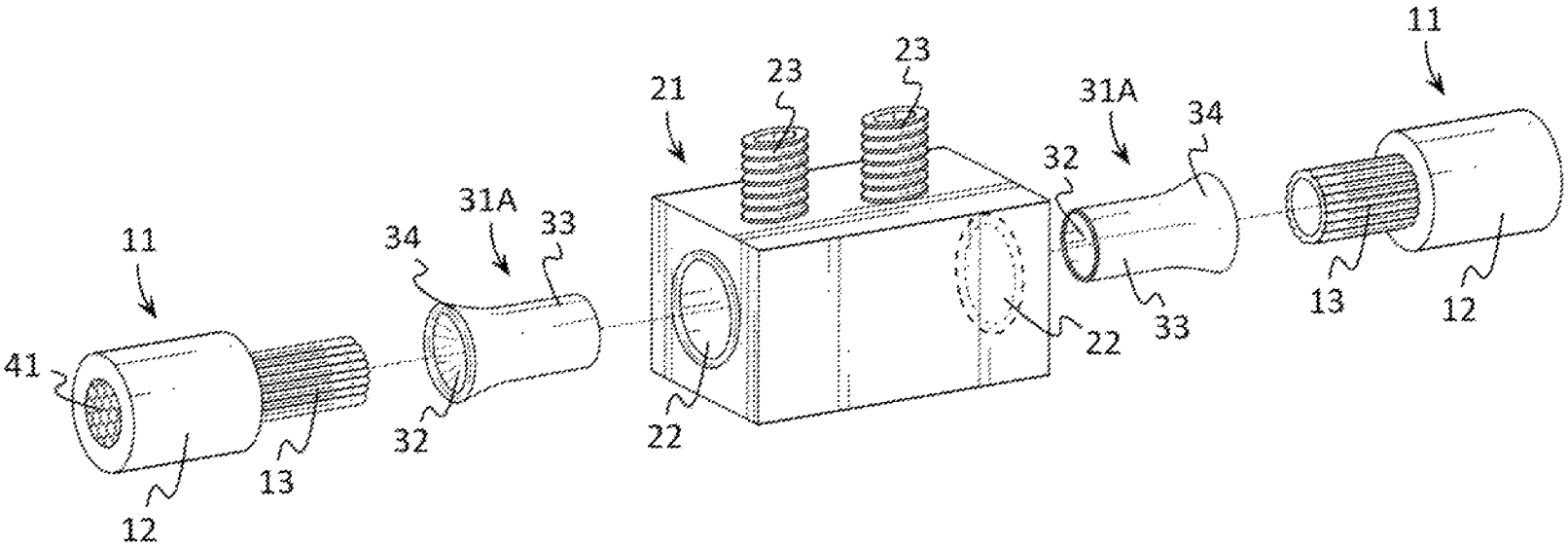
FIG. 3 shows a perspective view of another example of two electrical conductors, two ferrules, and an electrical connector having two connector apertures prior to the start of an electrical coupling method according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and methods illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new electrical coupling method is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-9 illustrate examples of steps and physical components of an electrical coupling method ("the method") 100 according to various embodiments. The method 100 may be used for coupling an electrical conductor 11 to an electrical connector 21.

Generally, an electrical conductor 11 may be a single, usually cylindrical, flexible strand or rod of metal. Typically, an electrical conductor 11 may be used to bear electrical current and signal voltage. All or portions of an electrical conductor 11 may commonly be formed by drawing metal through a hole in a die or draw plate. The cross-sectional area of an electrical conductor 11 may be described a wire gauges which come in various standard sizes, as expressed in terms of a gauge number. An electrical conductor 11 may refer to a single strand of electrically conductive material and also to refer to a bundle of such strands, as in "multistranded wire". Electrical conductors 11 configured as wire comes in solid core, stranded, or braided forms. Although usually circular in cross-section, a conductor 11 can be made in square, hexagonal, flattened rectangular, or other cross-sections.

An electrical conductor 11 may comprise a conducting material 41 which may comprise any material suitable for conducting electricity. In some embodiments, a conducting material 41 may comprise a solid wire or stranded wire which may include copper wire, aluminum wire, and copper coated aluminum wire. In further embodiments, a conducting material 41 may comprise a solid wire or stranded wire which may include an alloy having aluminum, copper, nickel, steel, and/or any other metal capable of forming an alloy that is suitable for conducting electricity. Conductive coatings on the conductor may comprise any suitable material such as copper, tin, nickel, iron, aluminum. Portions of an electrical conductor 11 may be coated or covered with an insulator 12 which may comprise any suitable electrically insulating material, such as plastic, rubber-like polymers, other polymers, and varnish. An electrical conductor 11 may comprise a terminus 13 of conducting material 41 which may comprise an end of the electrical conductor 11 that is not coated with or covered with an insulator 12 and may therefore be used to conduct electricity to another element, such as an electrical connector 21 and a ferrule 31.

Figure 8:
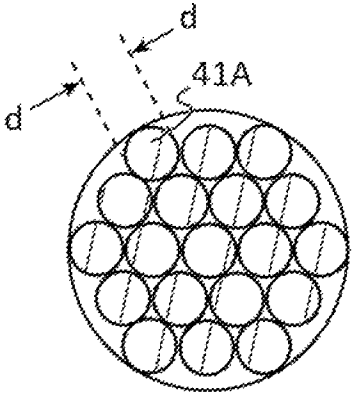
FIG. 8 illustrates a sectional, through line 8-8 shown in FIG. 7, elevation view of an example of an electrical conductor cross sectional area according to various embodiments described herein.
Figure 7:
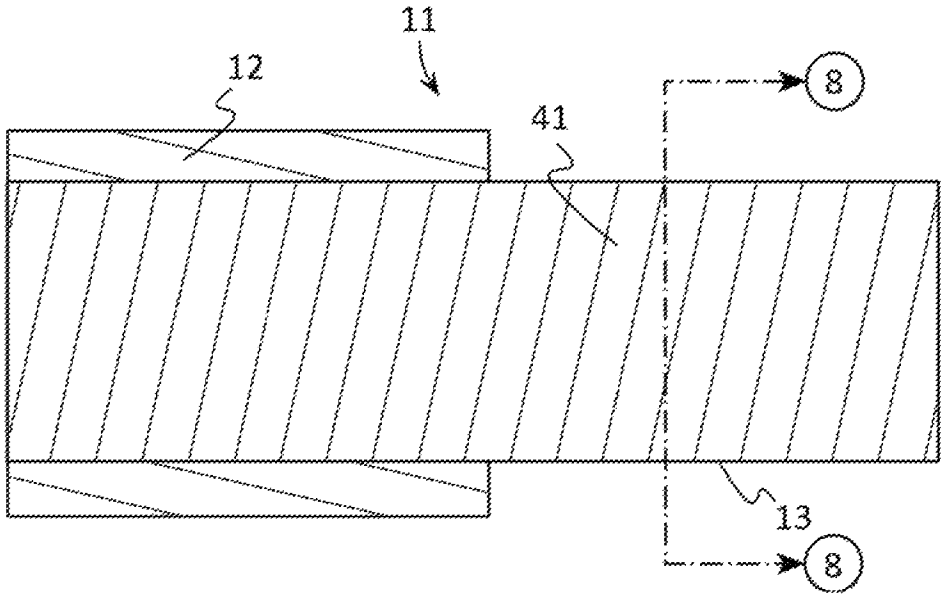
FIG. 7 depicts a side sectional view of an example of an electrical conductor according to various embodiments described herein.

As shown in FIGS. 7 and 8, each electrical conductor 11 may comprise a conductor cross sectional area (CCSA) which may describe the total cross sectional area of all of the one or more strands 41A of conducting material 41 of the electrical conductor 11. Any suitable method of determining the CCSA of an electrical conductor 11 may be used. For example, if the conductor comprises a number of strands 41A of conducting material 41A each having a generally circular cross section as shown in FIG. 8, then the diameter $(d_1)$, $(d_2)$, $(d_3)$ . . . $(d_n)$ of each individual strand 41A may be used to solve for area using $CCSA=(\pi d^2)/4$ where total CCSA is the sum of the individual strand 41A CSA given by $\pi/4*[(d_1^2)+(d_2^2)\pm d_3^2)+ \ldots (d_n^2)]$ where $d_1$, $d_2$, $d_3 \ldots d_n$ are the individual strand 41A diameters and n is the total number of strands. As another method suitable for conductor strands which are not circular, the CCSA is the total of the individual strand CSA given by $A_1+A_2+A_3 \ldots A_n$ where $A_1$, $A_2$, $A_3 \ldots A_n$ are the individual strand 41A CSA and n is the total number of strands. As another method, an electrical conductor 11 is typically described as having a standardized gauge, such as AWG, and the published cross sectional area of the gauge may be referenced and used as the CCSA. In another method, the metric system, gauge is already published as total CCSA in $mm^2$ (square millimeters).

An electrical connector 21 may comprise a structure having a connector conducting material 42 to which one or more electrical conductors 11 may be directly or indirectly coupled to. Similar to conductor conducting material 41, the conducting material 42 of the electrical connector 21 may comprise any material suitable for conducting electricity. In some embodiments, an electrical connector 21 may include one or more, such as two, three, four, five, six, or more, such as a plurality of, connector apertures 22, and each connector aperture 22 may comprise a clamping screw 23. A clamping screw 23 may comprise a threaded fastener, such as a screw, which may be threadedly engaged to the electrical connector 21 so that portions of the clamping screw 23 may be moved into and out of a connector aperture 22. A connector aperture 22 may comprise an opening of any shape and size into which portions of one or more electrical conductor 11 terminuses 13 and/or ferrules 31 may be inserted or positioned. A clamping screw 23 may be movably coupled to the electrical connector 21 so that portions of the clamping screw 23 may be moved into and out of the connector aperture 22.

In preferred embodiments, an electrical connector 21 may be manufactured according to one or more standards so that the electrical connector 21 may be of one or more standards, such as UL486A-B, C22.2 No. 65, and any other international standard. In further preferred embodiments, an electrical connector 21 may be manufactured according to one or more standards so that the electrical connector 21 may be a UL486A-B and a C22.2 No. 65 dual rated connector.

Figure 4:
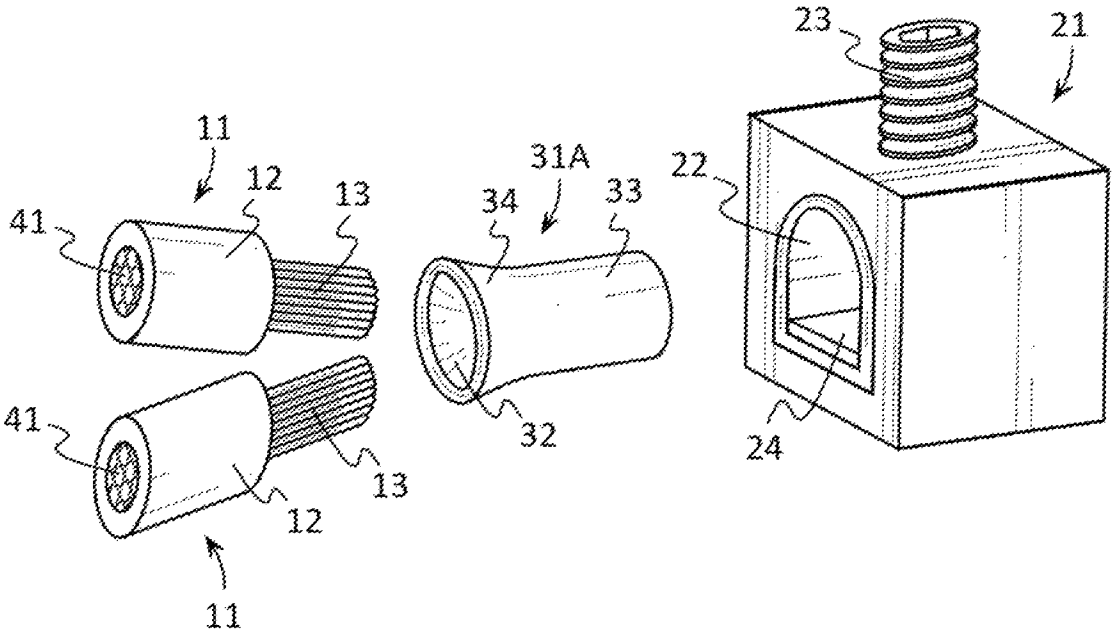
FIG. 4 depicts a perspective view of another example of two electrical conductors, a ferrule, and an electrical connector prior to the start of an electrical coupling method according to various embodiments described herein.

Optionally, an electrical connector 21 may comprise a conductive strip 24 or bus which may be positioned within a connector aperture 22, such as inside at the bottom of the connector aperture 22 as shown in FIG. 4. By tightening or screwing a clamping screw 23 in a connector aperture 22 having a conductive strip 24 an object, such as a conductor terminus 13 and/or a ferrule 31 may be clamped to the conductive strip 24 or bus by the clamping screw 23. A conductive strip 24 or bus may be made from or comprise any suitable electrically conductive material.

In some embodiments, one or more electrical conductors 11 may be directly coupled to an electrical connector 21 by positioning the electrical conductor(s) 11 in a connector aperture 22 and then tightening, screwing, or otherwise engaging the clamping screw 23 to a desired torque level so that the clamping screw 23 frictionally engages, couples, or secures the electrical conductor(s) 11 in the connector aperture 22. In further embodiments, one or more electrical conductors 11 may be indirectly coupled to an electrical connector 21 by positioning the terminus 13 of the electrical conductor(s) 11 in a ferrule aperture 32 of a ferrule 31 and positioning a cylindrical end 33 of the ferrule 31 in a connector aperture 22 of the connector 21. Then the clamping screw 23 of the connector 21 may be tightened, screwed, or otherwise engaged to a desired torque level so that the clamping screw 23 simultaneously crimps the cylindrical end 33 of the ferrule 31 to the terminus 13 and also secures, engages, or otherwise couples the ferrule 31 and the electrical conductor(s) 11 to the electrical connector 21 within the connector aperture 22.

A ferrule 31 may comprise an electric wire ferrule (sometimes called an end terminal) which typically may be configured generally as a metal tube crimped over solid and/or stranded wire of an electrical conductor 11 to control conductor strands when securing a conductor 11 within an electrical connector 21 such as a screw terminal. A ferrule 31 may comprise a cylindrical end 33 and a flared end 34. The flared end 34 may be larger or wider than the cylindrical end 33 to facilitate the insertion of one or more terminuses 13 into the ferrule aperture 32.

Figure 6:
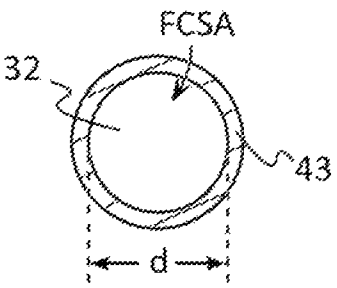
FIG. 6 shows a sectional, through line 6-6 shown in FIG. 5, elevation view of an example of a ferule aperture, cylindrical region, cross sectional area according to various embodiments described herein.
Figure 5:
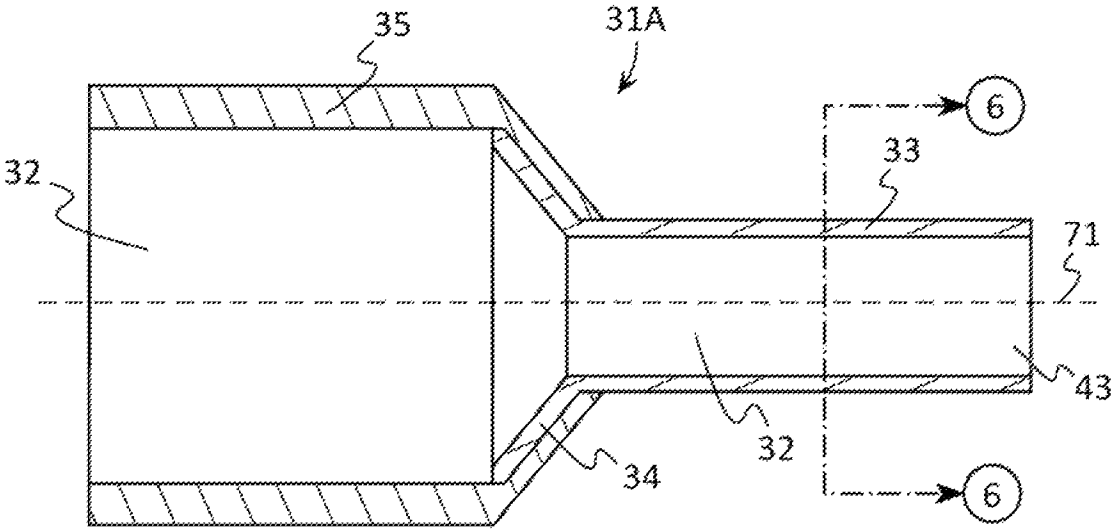
FIG. 5 illustrates a side sectional view of an example of a ferrule according to various embodiments described herein.

A ferrule aperture 32 may be disposed in the ferrule 31, and may extend from the flared end to the cylindrical end 33. A ferrule aperture 32 may be configured in any shape and size. As shown in FIGS. 5 and 6, each ferrule 31 may comprise a ferrule cross sectional area (FCSA) which may describe the cross sectional area of the ferrule aperture 32 of the ferrule 31. In preferred embodiments, all or portions of a ferrule aperture 32 may be configured with a generally cylindrical shape (as shown in FIG. 6) having a ferrule cross sectional area (FCSA) and the internal diameter (d) may be used to solve for area using $FCSA=(\pi d^2)/4$. As another method, a ferrule 31 is typically described as having a standardized gauge, such as AWG, or $mm^2$ and the published inside diameter of the ferrule of a certain gauge may be referenced and used to calculate the FCSA.

A ferrule 31 may optionally comprise an insulation cover 35, which may be coupled to the flared end 34, of electrical insulation which may be included to protect any exposed portion of the terminus 13 of an electrical conductor 11 not completely inside the ferrule aperture 32. Preferably, a ferrule 31 may comprise an insulation cover 35 coupled to the flared end 34. An insulation cover 35 may comprise any suitable electrically insulating material, such as plastic, rubber-like polymers, other polymers, and varnish.

A ferrule 31 may comprise a ferrule conducting material 43 which may comprise any material suitable for conducting electricity. In some embodiments, conducting material 43 of a ferrule 31 may comprise copper or a copper alloy material containing at least 80% copper. In further embodiments, a conducting material 43 of a ferrule 31 may comprise an alloy having aluminum, copper, nickel, steel, and/or any other metal capable of forming an alloy that is suitable for conducting electricity. In preferred embodiments, a ferrule 31 may be manufactured according to one or more standards so that the ferrule 31 may be of one or more standards, such as DIN 46228 part 1, DIN 46228 part 4, UL486A-B, C22.2 No. 65, UL486F, C22.2 No. 291, UL1059, C22.2 No. 158, UL486E, and any other international standard.

Figure 9:
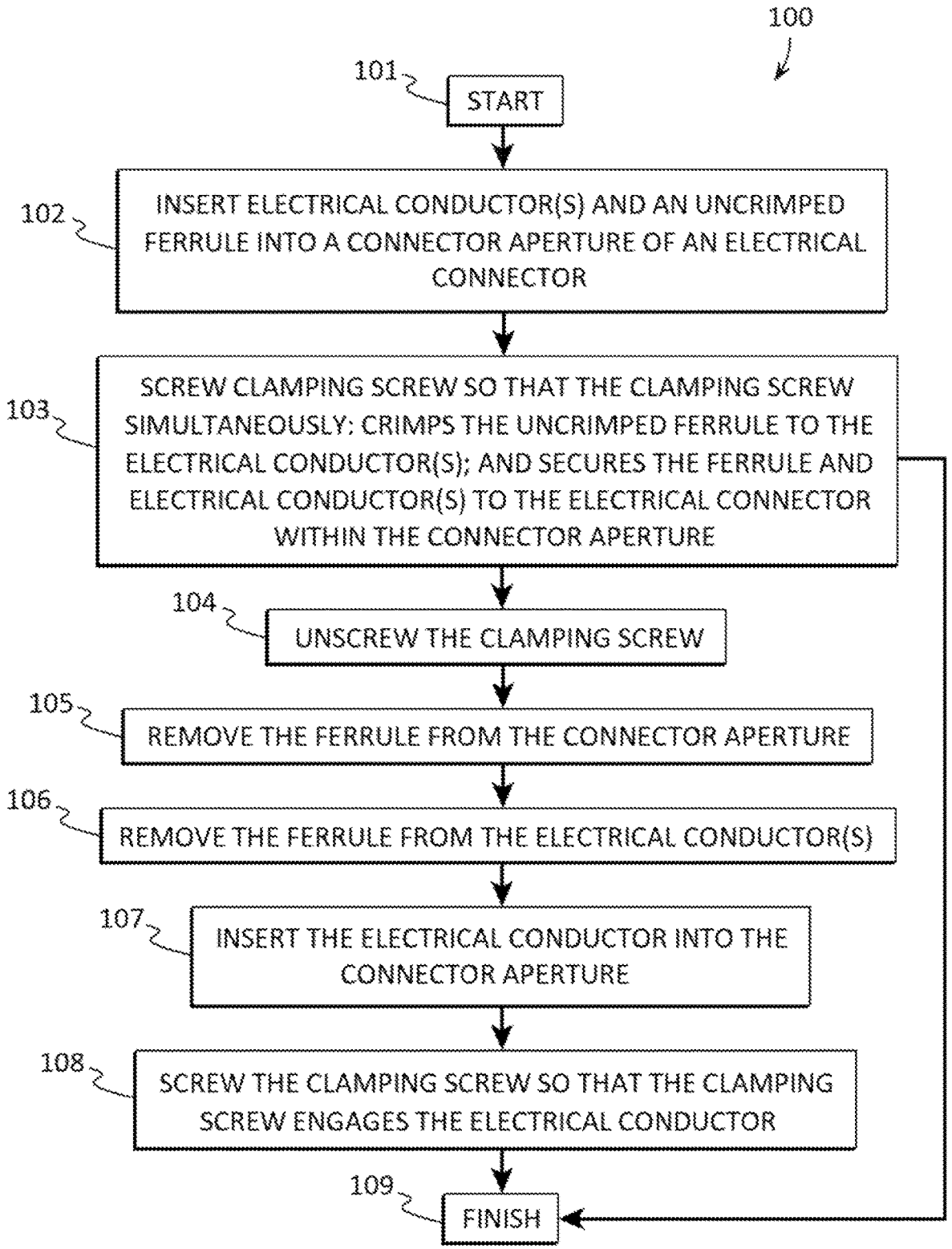
FIG. 9 shows a block diagram of an example of an electrical coupling method for coupling an electrical conductor to an electrical connector according to various embodiments described herein.

An example of an electrical coupling method ("the method") 100 according to various embodiments is shown in FIG. 9. The method 100 may be used for coupling one or more electrical conductors 11 to an electrical connector 21.

The method 100 may start in step 101. In some embodiments, one or more electrical conductors 11 and an uncrimped ferrule 31A may be inserted into a connector aperture 22 of an electrical connector 21. In preferred embodiments, the terminus 13 of each electrical conductor 11 may be positioned or inserted into the ferrule aperture 32 of the ferrule 31 and the cylindrical end 33 of the ferrule 31 may be inserted into the connector aperture 22 of the electrical connector 21 in any order or sequence.

In some embodiments, the terminus 13 of a single or first electrical conductor 11 may be inserted into the ferrule aperture 32 of an uncrimped ferrule 31A in step 102. In further embodiments, the ferrule 31 may comprise a ferrule aperture 32 having a ferrule cross sectional area (FCSA) and the conductor 11 may comprise a conductor cross sectional area (CCSA), and preferably the ratio of the FCSA to the CCSA may be between 1.4 to 2.1.

In some embodiments, the terminus 13 of a first electrical conductor 11, a second electrical conductor 11, a third electrical conductor 11, or any number of electrical conductors 11 may be inserted into the ferrule aperture 32 of an uncrimped ferrule 31A. Each terminus 13 may comprise a CCSA, describing the cross sectional area of the conducting material 41 forming the terminus 13, and preferably the ratio of the FCSA to the total combined CCSA's of each of the terminuses 13 that may be inserted into the ferrule aperture 32 may be between 2.3 to 3.4. For an example scenario having two conductors 11 which are inserted into a ferrule aperture 32, a first electrical conductor 11 may comprise a first conductor cross sectional area (CCSA1), a second electrical conductor 11 may comprise a second conductor cross sectional area (CCSA2), and the ratio of the FCSA to the total combined CCSA1 and CCSA2 may be between 2.3 to 3.4.

In further embodiments, a terminus 13 of one or more electrical conductors 11 may be inserted into a ferrule aperture 32 of an uncrimped ferrule 31A having a symmetrical shape and inserting a portion of the uncrimped ferrule 31A into a connector aperture 32 of an electrical connector 31, in which the electrical conductors 11 and uncrimped ferrule 31A may be in an uncoupled state upon insertion of the ferrule 31 into the connector aperture 32. An uncrimped ferrule 31A may comprise a ferrule 31 that has not been deformed so as to prevent the insertion and removal of a terminus 13 of one or more electrical conductors 11 into and out of the ferrule aperture 32. The uncrimped ferrule 31A may comprise a symmetrical shape, such as having a horizontal line of symmetry 71 which extends the length of the ferrule 31.

In step 103, the clamping screw 23 may be screwed so that the clamping screw 23 simultaneously: crimps the uncrimped ferrule 31A to the electrical conductor(s) 11 (resulting in a crimped ferrule 31B); and secures the ferrule 31 and electrical conductor(s) 11 to the electrical connector 21 within the connector aperture 22. In further embodiments, the clamping screw 23 of the electrical connector 21 may be engaged, screwed, or otherwise motivated, so that the clamping screw 23 simultaneously: deforms the symmetrical shape of the ferrule 31 to frictionally couple the one or more electrical conductors 11 to the ferrule 31 (within the ferrule aperture 32); and frictionally couples the ferrule 31 to the electrical connector 21 within the connector aperture. A crimped ferrule 31B may comprise a ferrule 31 that has been deformed, such as by having portions of the cylindrical end 33 crushed, by the clamping screw 23 so as to prevent the insertion and removal of a terminus 13 of one or more electrical conductors 11 into and out of the ferrule aperture 32. The crimped ferrule 31B may comprise an unsymmetrical shape, such as by no longer having a horizontal line of symmetry 71 which extends the length of the ferrule 31.

In preferred embodiments, the clamping screw 23 may be tightened to a desired torque level. A desired torque level may prevent or resist the ability of the ferrule 31 and/or one or more conductors 11 received in the ferrule aperture 32 from being pulled out of the ferrule aperture 32 and/or the connector aperture 22.

In some embodiments, the total CCSA of all conductors 11 inserted into the connector aperture 22 may be between 0.25 $mm^2$ to 2.5 $mm^2$, and the desired torque level results in a pull out force for each of the conductors 11, in Newtons, so that the pull out force is between [(95.382*total CCSA)] and [(158.97*total CCSA)].

In some embodiments, the total CCSA of all conductors 11 inserted into the connector aperture 22 may be between 2.51 $mm^2$ to 400 $mm^2$, and the desired torque level results in a pull out force for each of the conductors 11, in Newtons, so that the pull out force is between [(−0.0124*total $CCSA^2$)+(16.076*total CCSA)+240] and [(−0.0187*(total $CCSA^2$)+(24.114*total CCSA)+416.68].

After step 103 and in some embodiments, the method 100 may finish 109.

In further embodiments, the method 100 may comprise one or more optional steps 104-108.

In some embodiments, the method 100 may comprise optional step 104 in which the clamping screw 23 may be unscrewed so that the clamping screw 23 does not hinder the removal of the ferrule 31 and/or one or more conductors 11 from the connector aperture 22.

In some embodiments, the method 100 may comprise optional step 105 in which the ferrule 31, and therefore the one or more conductors 11 coupled within the ferrule aperture 32, may be removed from the connector aperture 22 of the electrical connector 21.

In some embodiments, the method 100 may comprise optional step 106 in which the ferrule 31 may be removed from the electrical conductor(s) 11, such as by deforming, cutting or trimming the ferrule 31 so that the electrical conductor(s) 11 are no longer crimped within the ferrule aperture 32, to allow the terminuses 13 of the one or more electrical conductor(s) 11 to be removed from the ferrule aperture 32.

In some embodiments, the method 100 may comprise optional step 107 in which the one or more electrical conductors 11 may be inserted into the connector aperture 22 of the electrical connector 21, such as by inserting the terminuses 13 of the respective electrical conductors 11 into the connector aperture 22.

In some embodiments, the method 100 may comprise optional step 108 in which the clamping screw 23 may be screwed or tightened so that the clamping screw 23 engages the one or more electrical conductors 11, such as by engaging the terminuses 13 of the one or more electrical conductors 11 within the connector aperture 22.

After step 108, the method 100 may finish 109.

While some exemplary shapes and sizes have been provided for the elements described herein, it should be understood to one of ordinary skill in the art that any element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A method for coupling an electrical conductor to an electrical connector, the method comprising the steps of:

inserting a first electrical conductor and an uncrimped ferrule into a connector aperture of the electrical connector, the first electrical conductor and uncrimped ferrule being uncoupled to each other prior to insertion into the connector aperture; and screwing a clamping screw so that the clamping screw simultaneously (i) crimps the uncrimped ferrule to the first electrical conductor and (ii) secures the ferrule and first electrical conductor to the electrical connector within the connector aperture; and wherein the ferrule comprises a ferrule aperture having a ferrule cross sectional area (FCSA) and the conductor comprises a conductor cross sectional area (CCSA), and wherein a ratio of the FCSA to the CCSA is between 1.4 to 2.1.

2. The method of claim 1, wherein the ferrule is of a standard selected from at least one of a DIN 46228 part 1, DIN 46228 part 4, UL486A-B, C22.2 No. 65, UL486F, C22.2 No. 291, UL1059, C22.2 No. 158, and UL486E.

3. The method of claim 2, wherein the ferrule is manufactured with one of a copper and a copper alloy material containing at least 80% copper.

4. The method of claim 1, wherein the first electrical conductor comprises a conducting material selected from copper wire, aluminum wire, and copper coated aluminum wire.

5. The method of claim 1, wherein the ferrule comprises a flared end, and wherein the ferrule comprises an insulation cover coupled to the flared end.

6. The method of claim 1, wherein a second electrical conductor is inserted with the first conductor in the ferrule aperture.

7. The method of claim 6, wherein the second electrical conductor comprises a second conductor cross sectional area (CCSA2), and wherein the ratio of the FCSA to the total combined sum of CCSA and CCSA2 is between 2.3 to 3.4.

8. The method of claim 6, wherein total CCSA of all conductors inserted into the connector aperture is between 2.51 $mm^2$ to 400 $mm^2$, wherein a desired torque level results in a pull out force for each of the conductors, in Newtons, and wherein the pull out force is between [(−0.0124*total $CCSA^2$)+(16.076*total CCSA)+240] and [(−0.0187*(total $CCSA^2$)+(24.114*total CCSA)+416.68].

9. The method of claim 1, wherein the electrical connector comprises more than one connector aperture and each connector aperture comprises a clamping screw.

10. The method of claim 1, wherein the electrical connector is a UL486A-B and a C22.2 No. 65 dual rated connector.

11. A method for coupling an electrical conductor to an electrical connector, the method comprising the steps of:

inserting a terminus of a first electrical conductor into a ferrule aperture of an uncrimped ferrule having a symmetrical shape and inserting a portion of the uncrimped ferrule with a portion of the first electrical conductor into a connector aperture of the electrical connector, the first electrical conductor and the uncrimped ferrule being in an uncoupled state upon insertion of the ferrule with the first electrical conductor into the connector aperture; and engaging a clamping screw of the electrical connector so that the clamping screw simultaneously (i) deforms the symmetrical shape of the ferrule to frictionally couple the first electrical conductor to the ferrule and (ii) frictionally couples the ferrule to the electrical connector within the connector aperture; and wherein the electrical connector is a UL486A-B dual rated connector.

12. The method of claim 11, wherein the ferrule comprises the ferrule aperture having a ferrule cross sectional area (FCSA) and the conductor comprises a conductor cross sectional area (CCSA), and wherein the ratio of the FCSA to the CCSA is between 1.4 to 2.1.

13. A method for coupling an electrical conductor to an electrical connector, the method comprising the steps of:

inserting the electrical conductor and an uncrimped ferrule into a connector aperture of the electrical connector, the electrical conductor and uncrimped ferrule being uncoupled to each other prior to insertion into the connector aperture;

screwing a clamping screw so that the clamping screw simultaneously (i) crimps the uncrimped ferrule to the electrical conductor and (ii) secures the ferrule and electrical conductor to the electrical connector within the connector aperture;

wherein the clamping screw is tightened to a desired torque level; and wherein total conductor cross sectional area (total CCSA) of the electrical conductor inserted into the connector aperture is between 0.25 $mm^2$ to 2.5 $mm^2$, wherein the desired torque level results in a pull out force for the electrical conductor, in Newtons, and wherein the pull out force is between [(95.382*total CCSA)] and [(158.97*total CCSA)].

* * * * *